US007550688B2

(12) United States Patent
Baertl et al.

(10) Patent No.: US 7,550,688 B2
(45) Date of Patent: Jun. 23, 2009

(54) TAP CHANGER HAVING A SWITCHING MONITORING DEVICE

(75) Inventors: Reinhold Baertl, Lappersdorf (DE); Dieter Dohnal, Lappersdorf (DE); Albert Schmidbauer, Roding (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 0 days.

(21) Appl. No.: 12/096,639

(22) PCT Filed: Oct. 21, 2006

(86) PCT No.: PCT/EP2006/010169

§ 371 (c)(1),
(2), (4) Date: Aug. 15, 2008

(87) PCT Pub. No.: WO2007/065499

PCT Pub. Date: Jun. 14, 2007

(65) Prior Publication Data

US 2008/0302639 A1 Dec. 11, 2008

(30) Foreign Application Priority Data

Dec. 9, 2005 (DE) ..... 10 2005 058 793

(51) Int. Cl.
*H01H 19/00* (2006.01)

(52) U.S. Cl. ..... 200/11 TC; 200/6 B; 200/17 B; 200/18

(58) Field of Classification Search ..... 200/5 R, 200/6 B, 6 BA, 6 BB, 11 TC, 11 TW, 17 B, 200/17 R, 18
See application file for complete search history.

(56) References Cited

U.S. PATENT DOCUMENTS

| | | | | |
|---|---|---|---|---|
| 6,813,509 | B2 * | 11/2004 | Aquilar et al. | 455/550.1 |
| 7,175,390 | B2 | 2/2007 | Wobben | 416/61 |
| 2005/0269191 | A1 | 12/2005 | Lindsey | 200/11 TC |

FOREIGN PATENT DOCUMENTS

| | | | |
|---|---|---|---|
| CH | 331114 | | 6/1958 |
| DE | 1039129 | | 9/1958 |
| JP | 59029409 A | * | 2/1984 |
| WO | WO-2006092164 | | 9/2006 |

* cited by examiner

*Primary Examiner*—Ramon M Barrera
(74) *Attorney, Agent, or Firm*—Andrew Wilford

(57) ABSTRACT

The invention relates to a tap changer having a switching monitoring device, which is arranged above the upper transmission stage in a housing. For monitoring purposes, two cam switches are provided which are actuated by a cam disk which is connected to the contact-bearing switch column of the tap changer. The cam disk has a horizontally split contour at its end face, wherein one of the two cam switches runs on each partial contour.

9 Claims, 4 Drawing Sheets

TAP CHANGER HAVING A SWITCHING MONITORING DEVICE

CROSS REFERENCE TO RELATED APPLICATIONS

Figure 1:
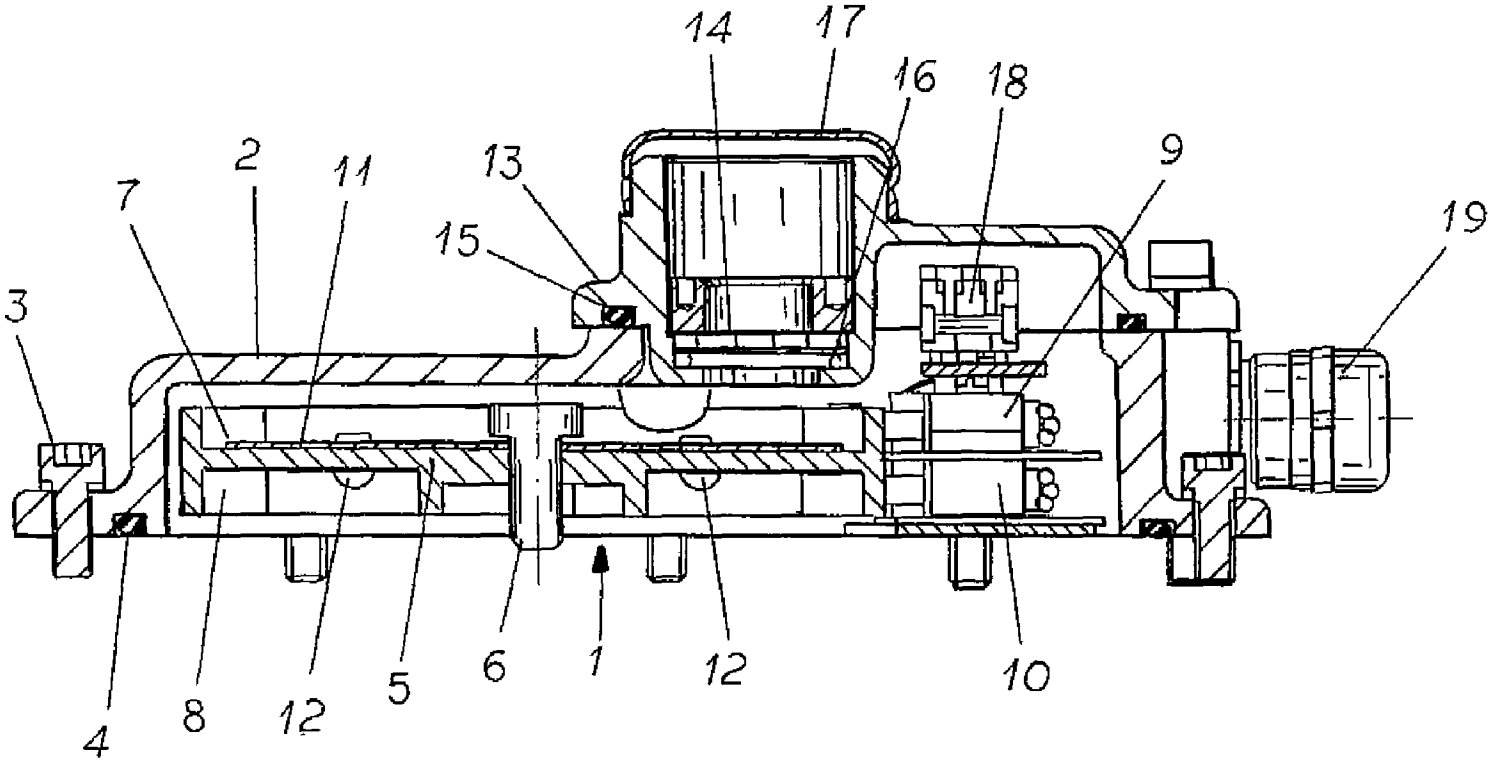

This application is the US national phase of PCT application PCT/EP2006/010169, filed 21 Oct. 2006, published 14Jun. 2007 as WO 2007/065499, and claiming the priority of German patent application 102005058793.3 itself filed 9 Dec. 2005,whose entire disclosures are herewith incorporated by reference.

The invention relates to a tap changer with a switching monitoring device for a tapped transformer.

A tap changer serves for power-free switching over between different winding taps of a tapped transformer. By contrast to an on-load tap changer, in which the switching over takes place under load without interruption, in the case of a tap changer provided for switching over it is necessary for the corresponding transformer to be completely switched off before the start of each switching over and may be switched back on only after complete conclusion of the switching over.

Such a tap changer is known from the Applicant's operating manual "Umsteller DEETAP® U," Operating Manual BA249, issue date October 2003. Such a known tap changer can be actuated by a manual drive or a motor drive, which respectively act on an upper transmission stage, but also by a direct handwheel drive or also a switch key.

In the most frequent case of actuation by a manual drive or motor drive an upper transmission stage is provided at the tap changer head. The drive shaft actuated by the manual drive or motor drive leads into this upper transmission stage; a Geneva crank going out of the upper transmission stage and executing a revolution in each switching over engages in a Geneva wheel which, for its part, in turn is connected with a centrally arranged, rotatable switching column of the tap changer. The rotatable switching column carries the movable switch contacts of the tap changer. This switching column is, as described, arranged centrally in the interior of an insulating material frame or cylinder, at the circumference of which the fixed tap changer contacts, which are selectably switchable by the rotationally movable switch contacts, are arranged in several horizontal planes.

A switching over is accordingly undertaken by actuation of the manual drive or motor drive in the following manner: The drive shaft leading into the upper transmission stage rotates and this rotation is transmitted to the Geneva drive, which engages in the Geneva wheel, which is connected with the switching column, and further rotates this wheel through one switching step. The switching column thereby rotates through the same angle, and the movable contacts arranged thereat leave the fixed contacts previously contacted by them and subsequently produce a new electrical contact with adjacent other fixed contacts. The switching over is thereby concluded and the transformer can be switched on again.

In the known tap changer a switching monitoring device is provided above the described upper transmission stage. This switching monitoring device contains two mechanically actuated microswitches, executed as cam switches S80, S90.

The first cam switch S80 is actuated in each operational setting, i.e. it changes its switching state after adjustment of the tap changer from one operational setting to the next. After adjustment into the next, succeeding operational setting it returns to the original switch setting. For that purpose a profile, on which the first cam switch runs, is actuated by the drive shaft via a small intermediate transmission.

The second cam switch S90 is actuated in each switching step of the tap changer, i.e. it returns to the original switch setting after adjustment of the tap changer by one switching step. For this purpose a cam disk carrying a cam-shaped profile at its circumference is fastened above the Geneva wheel. The number of cams corresponds with the number n of the possible switch settings. The second cam switch runs on this end profile. During switching over, the switching column and thus also the cam disk are rotated by the Geneva wheel through an angle of 360 degrees/n.

The two described cam switches are electrically connected in such a manner that triggering of the transformer power switch takes place when

- the tap changer shaft is rotated, i.e. the second cam switch S90 opens,
- the drive of the tap changer is actuated, i.e. the first cam switch S80 opens.

Thereagainst, switching back on of the transformer power switch is possible only when

- the tap changer is in a defined operational setting
- in addition the drive of the tap changer is similarly in a defined operational setting.

This known switching monitoring device has various disadvantages. It can detect only whether the drive linkage is broken or decoupled, but not breakage or a faulty functioning of the Geneva transmission, which consists of Geneva drive and Geneva wheel, for drive of the switching column of the tap changer. In the case of such a breakage, which the switching monitoring device does not recognize, serious damage can occur due to the fact that the tap changer is not disposed in a defined operational setting. A further disadvantage of the known device consists in that due to the physically separate position and different mode of actuation of the two cam switches setting and adjustment are complicated and of awkward design.

The object of the invention is accordingly to indicate a tap changer with a switching monitoring device which

- also monitors faulty functioning of the Geneva drive,
- is constructed and adjustable in simple manner and
- is in addition easily accessible.

This object is fulfilled by a tap changer with the features of the first patent claim. The subclaims relate to particularly advantageous developments of the invention.

The advantages of the tap changer according to the invention and its switching monitoring device can be summarized as follows:

- direct connection with the switching column, so that reliable detection of any impermissible setting of the switching column, i.e. any departure from a permissible operational setting,
- simple mounting and wiring via a separate housing with a cover and
- setting and adjustment of the two cam switches in simple manner through the common arrangement thereof.

The principal advantage resides, as described, in the fact that not only a breakage of the drive linkage, but also—which is new—a breakage of the Geneva transmission can be reliably detected.

According to a particularly advantageous development of the invention an optical setting indication is additionally integrated, which can be read off in simple manner from above through a viewing glass or the like.

Figure 2:
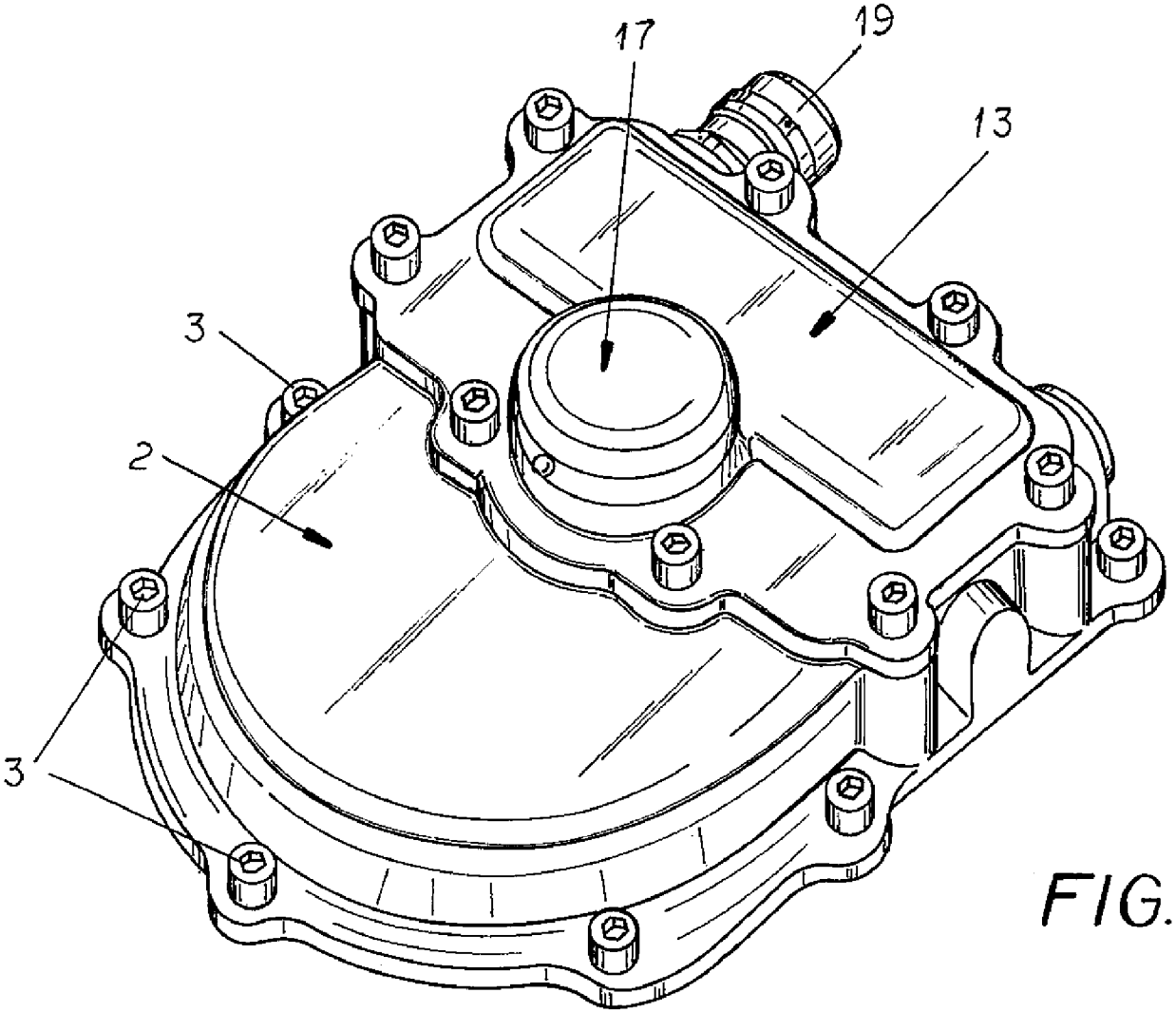
Figure 3:
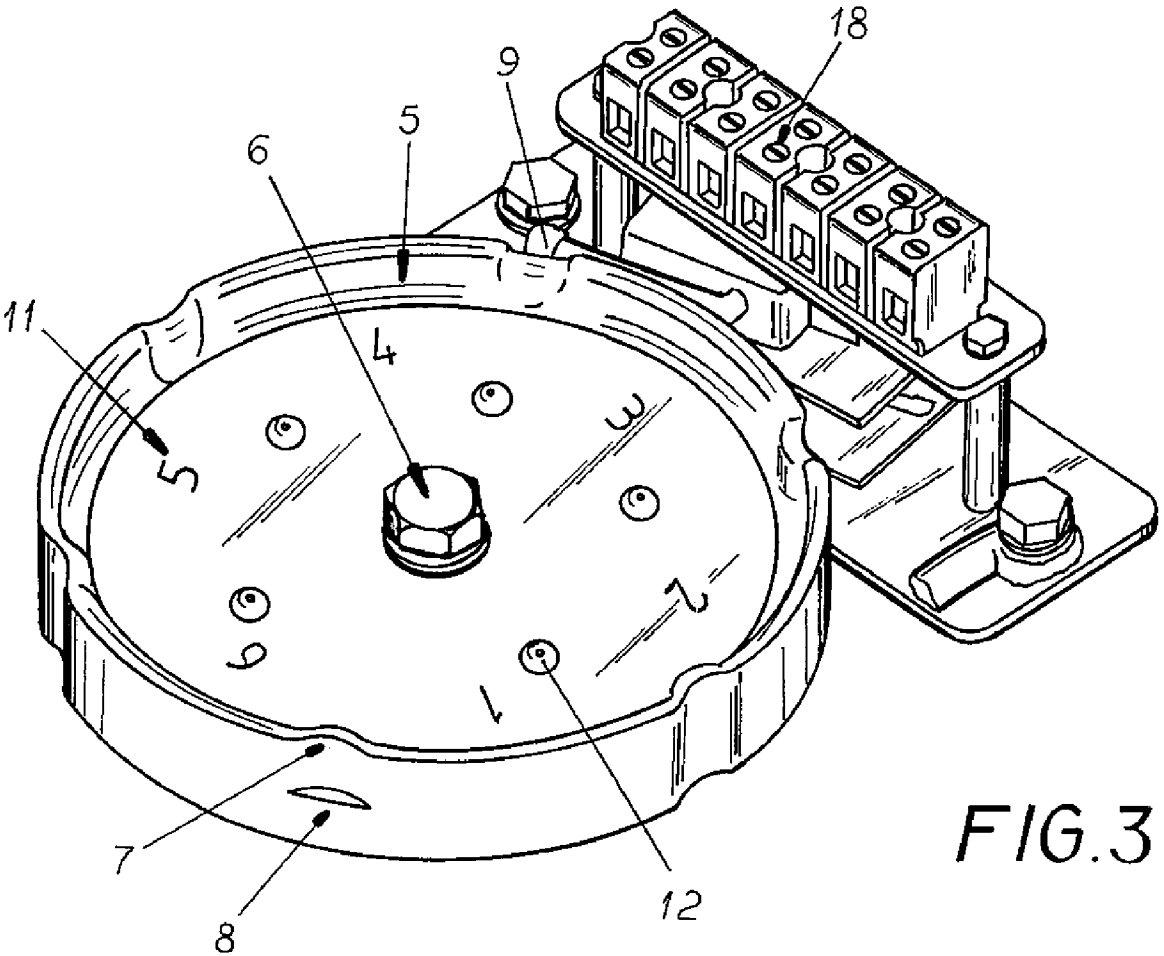
Figure 4:
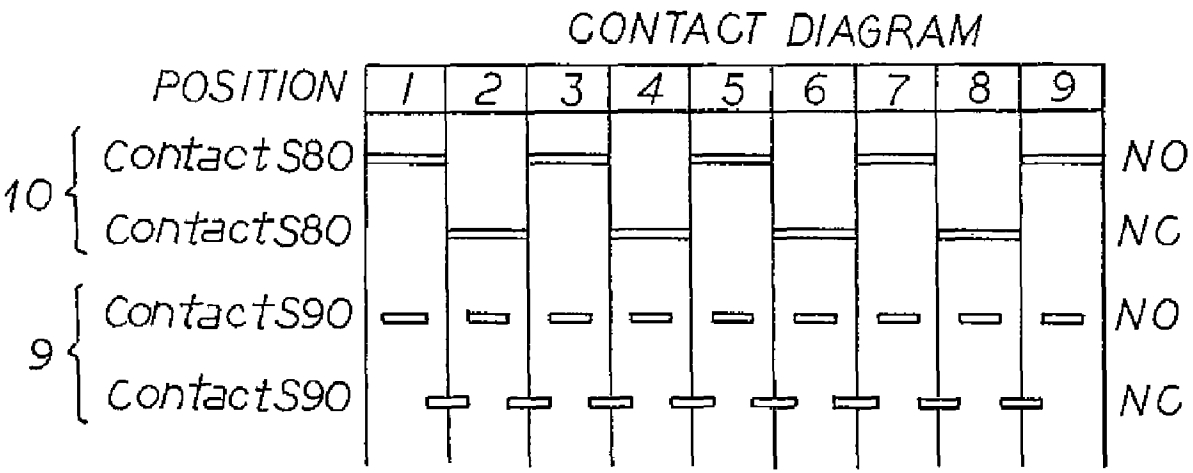

The invention is explained in more detail in the following by way of example with reference to drawings, in the figures of which:

FIG. 1 shows a switching monitoring device of a tap changer according to the invention in a schematic side sectional illustration, FIG. 2 shows the switching monitoring device from above, closed, in a perspective illustration, FIG. 3 shows the internal components of this switching monitoring device by themselves, in the same perspective illustration, and FIG. 4 shows a contact diagram of the two cam switches of the illustrated switching monitoring device.

The construction of the switching monitoring device according to the invention shall initially be explained by way of FIGS. 1 to 3.

The switching monitoring device 1 is arranged in a separate housing 2 above the upper transmission stage of the tap changer. The housing 2 is fastened to the upper transmission stage by means of fastening screws 3. An encircling seal 4 is additionally provided therebetween. In the interior the device has a horizontally arranged cam disk 5 which is connected by means of a screw connection 6 with the Geneva transmission (not illustrated) and thus directly with the switching column of the tap changer. The cam disk 5 has at its end face an upper end profile 7 and a lower end profile 8, wherein the two profiles 7, 8 extend horizontally and in parallel. The upper end profile 7 corresponds with an upper cam switch 9, which has the function of the cam switch S90 of the state of the art. The lower end profile 8 co-operates with a lower cam switch 10, which functionally corresponds with the cam switch S80 of the state of the art.

In a particularly advantageous form of embodiment of the invention a numerals disk 11 is fastened, for example by means of rivets 12, on the cam disk 5. The numerals disk 11 carries on its upper side individual numerals which correspond with the possible settings of the tap changer. It is obviously also possible within the scope of the invention to provide these numerals on the upper side of the cam disk 5 itself. A cover 13 is located in the upper region of the housing 2 and screwed on. It has a viewing glass 14 in the interior. The corresponding seals 15, 16 are also illustrated in FIG. 1. A cover 17 is provided at the upper end of the cover 13, above the viewing glass 14, as protection. The viewing glass 14 is so arranged that in each instance one of the numerals on the numerals disk 11 can be read off from above. Connecting terminals 18 for connection of the electrical lines to the cam switches 9, 10 are disposed laterally below the cover 13. A screw connection 19 for taking out the electrical lines is also shown laterally.

The function of the switching monitoring device according to the invention is as follows: On each actuation of the tap changer, which has n switching settings, the Geneva wheel (not illustrated) is rotated through an angle of 360 degrees/n. The cam disk 5 connected therewith is also rotated through the same angle. The upper end profile 7 is such that at the start of the rotational movement the corresponding upper cam switch 9 is urged outwardly and after the conclusion of the rotational movement, when the tap changer has reached the new operational setting, drops back into a new cam. The lower end profile 8, thereagainst, is such that at the start of the rotational movement the corresponding lower cam switch 10 is similarly urged outwardly, but remains in this setting after the conclusion of the rotational movement when the tap changer has reached the new operational setting. Only with the succeeding next switching over, when this is concluded, does it drop into a further cam. It results therefrom that the number of inwardly directed cams, i.e. notches, on the upper end profile 7 corresponds with the number n of possible switch settings of the tap changer. The number of inwardly directed cams, i.e. notches, on the lower end profile 8 thereagainst is only half as many, i.e. a cam of the lower end profile 8 is disposed only under each second cam of the upper end profile 7.

The contact diagram of the two cam switches 9, 10 is illustrated by itself in FIG. 4. The upper cam switch 9 is actuated in each switching step, i.e. each actuation of the tap changer; it returns to the original switch setting after adjustment of the tap changer through one switching step. The lower cam switch 10, thereagainst, is actuated in each operational setting, i.e. it permanently changes its switching state after each adjustment of the tap changer from one operational setting to the next. Only after a further adjustment of the tap changer into the further next operational setting following thereupon does it return to its original switch setting.

The switching monitoring device 1 according to the invention in its separate housing 2 has a whole series of advantages. At the outset, a simple assembly and wiring is possible, for which purpose only the cover 13 has to be opened; interventions in the device itself are no longer necessary. An optical setting indication is integrated in simple manner in the explained, particularly advantageous form of embodiment. The corresponding numerals are arranged in such a manner on the numerals disk 11 or also on the upper side of the cam disk 5 that the respectively switched instantaneous setting of the tap changer is visible from above through the viewing glass 14. The two cam switches 9, 10 can be arranged and set in simple manner, for example on a common plate.

A particular advantage of the arrangement according to the invention consists in that not only—as usual in accordance with the state of the art—is there monitoring whether the drive linkage is broken, but in addition a breakage or faulty functioning at the Geneva drive is also detected. The latter is due to the fact that the cam disk 5 is directly connected with the Geneva drive. A direct connection with the switching column is thus given. In other words: the monitoring in accordance with the invention takes place directly at the switching column without intermediate drive or transmission trains, which could cause additional, undetected faults.

In particularly advantageous manner the two cam switches 9, 10 are arranged vertically one above the other and so conceived that no assembly or disassembly has to be undertaken on the part of the user.

The invention claimed is:

1. A tap changer with switching monitoring device, wherein the tap changer comprises an upper transmission stage actuatable by a drive shaft, wherein the upper transmission stage in turn drives a Geneva transmission, wherein a Geneva wheel of the Geneva transmission is mechanically connected with a switch column arranged centrally in the tap changer and carrying contacts and wherein the switching monitoring device is arranged above the upper transmission stage in a housing and comprises two cam switches wherein the switching monitoring device comprises a horizontally arranged cam disk which is mechanically connected with the Geneva wheel and thus directly with the switch column, the cam disk has at its end face an encircling upper end profile and a lower end profile, wherein the two profiles extend horizontally and parallel, and the first cam switch runs on the upper end profile and the second cam switch runs on the lower end profile.

2. The tap changer with switching monitoring device according to claim 1, wherein the upper end profile is geometrically constructed in such a manner that at the beginning of the rotational movement of the cam disk the upper cam switch running thereon is urged outwardly and after the end of the rotational movement drops back into a new cam and that the lower end profile is geometrically constructed in such a manner that at the beginning of the rotational movement of the cam disk the lower cam switch running thereon is similarly urged outwardly, but after the end of the rotational movement remains in this setting and drops back into a further cam only when the succeeding next rotational movement takes place.

3. The tap changer with switching monitoring device according to claim 2, wherein the number of inwardly directly cams on the upper end profile corresponds with the number n of possible switching settings of the tap changer and that the number of inwardly directed cams on the lower end profile corresponds with half the number of the possible switching settings of the tap changer.

4. The tap changer with switching monitoring device according to claim 1, wherein the two cam switches are arranged vertically one above the other in a plane perpendicular to the cam disk.

5. The tap changer with switching monitoring device according to claim 1, wherein numerals corresponding with the possible settings of the tap changer are arranged on the upper side of the cam disk, that a viewing glass is provided in the upper region of the housing and the viewing glass is so arranged that the respective numeral corresponding with the instantaneous setting of the tap changer can be read off from above.

6. The tap changer with switching monitoring device according to claim 5, wherein the numerals are arranged on a separate numerals disk fastened on the cam disk.

7. The tap changer with switching monitoring device according to claim 1, wherein the cam disk is arranged directly on the switching column above the Geneva wheel.

8. The tap changer with switching monitoring device according to claim 7, wherein a mechanically positive connection between cam disk and Geneva wheel is present.

9. The tap changer with switching monitoring device according to claim 1, wherein the switching monitoring device is arranged above the tap changer head centrally in the housing.

* * * * *